United States Patent [19]

Tatematsu et al.

[11] Patent Number: 4,531,555

[45] Date of Patent: Jul. 30, 1985

[54] YARN CUTTER FOR SHUTTLELESS LOOM

[75] Inventors: Hiroyuki Tatematsu; Haruhiko Kusakabe; Masamitsu Takaki; Gendai Kojima; Sigeru Miyamoto, all of Ohtsu, Japan

[73] Assignee: Toray Industries, Inc., Tokyo, Japan

[21] Appl. No.: 459,127

[22] Filed: Jan. 19, 1983

[51] Int. Cl.[3] ..... D03D 47/34

[52] U.S. Cl. ..... 139/429; 139/450; 139/302; 30/345

[58] Field of Search ..... 139/429, 450, 302, 303; 83/915.5, 694; 30/254, 345; 76/DIG. 1; 26/9

[56] References Cited

U.S. PATENT DOCUMENTS

| | | | |
|---|---|---|---|
| 2,869,311 | 1/1959 | Beeston | 30/345 |
| 3,376,903 | 4/1968 | Golobart | 139/302 |
| 4,080,735 | 3/1978 | Michalski | 30/345 |
| 4,263,790 | 4/1981 | Stopp et al. | 26/9 |
| 4,275,773 | 6/1981 | Shibata | 139/302 |
| 4,317,401 | 3/1982 | Disharoon | 83/915.5 |

*Primary Examiner*—Henry S. Jaudon

*Attorney, Agent, or Firm*—Armstrong, Nikaido, Marmelstein & Kubovckik

[57] ABSTRACT

A yarn cutter for a shuttleless loom, particularly for a water jet loom, comprising a pair of knife bodies each having a cutting edge formed of a ceramic and being driven for relative sliding motion in mutual contact.

8 Claims, 8 Drawing Figures

YARN CUTTER FOR SHUTTLELESS LOOM

BACKGROUND

The present invention relates to a yarn cutter for a shuttleless loom and more particularly to a yarn cutter which is suitable for use as a weft yarn cutter for a water jet loom and superior in corrosion resistance, wear resistance and toughness in a weaving process.

Recent water jet looms operate at a very high speed of 400 to 800 rpm and jet 2 to 4 cc of water at every pick. Accordingly, in a yarn cutter employing a metallic blade for cutting weft yarns, the blade is liable to rust due to the wet operating environment and the cutting performance of the blade deteriorates within a short operating period of time due to repetition of high-speed cutting operation, so that such a yarn cutter has a disadvantage that the durability is unsatisfactory. Some yarn cutters employ an electric heater instead of a metallic blade, however, such yarn cutters also have a problem in respect of durability and often fail in cutting a weft yarn due to cooling of the electric heater by wet weft yarns. The large power consumption of such a yarn cutter employing an electric heater as large as approximately 30% of the total power consumption of the loom is a serious problem. When thick yarns of 200 to 500 deniers or spun yarns which are likely to be wet with water are used as weft yarns, sometimes, the electric heater consumes a large electric power as great as 50% of the total power consumption of the loom, which is economically disadvantageous.

SUMMARY

Primary object of the present invention is to provide a yarn cutter for a shuttleless loom, which is superior in corrosion resistance, wear resistance and toughness.

Another object of the present invention is to provide a yarn cutter for a shuttleless loom, consuming less electric power.

In order to attain abovementioned objects, a yarn cutter for a shuttleless loom according to the present invention comprises a pair of knife bodies each having a cutting edge and being adapted to slide in mutual contact, wherein at least one of the cutting edges is made of a ceramic material.

The yarn cutter may be a scissors type or may be a so called cylinder cutter type consisting of a combination of a cylinder body and a piston body fitted in the cylinder body. In such yarn cutters as mentioned immediately above, it is preferable that one of the knife body is stationary, while the other is movable in contact with the former.

According to the present invention, it is desirable to form the cutting edges of both knife bodies of a ceramic material, however, only one of the cutting edges may be formed of a ceramic material, while the other is formed of a metal such as a sintered hard alloy. In the yarn cutter of the present invention, at least the cutting edge is required to be made of a ceramic material or the cutting edge and the knife body may inclusively be made of a ceramic material. Forming at least the cutting edge with a ceramic material provides corrosion resistance, wear resistance and toughness, which can not be attained by the metal cutters.

It is desirable to provide a water supplying means in the vicinity of the abovementioned yarn cutter for supplying water to the cutting edges. The provision of such a water supplying means will further extend the life of the yarn cutter.

THE DRAWINGS

THE PREFERRED EMBODIMENTS

Figure 1:
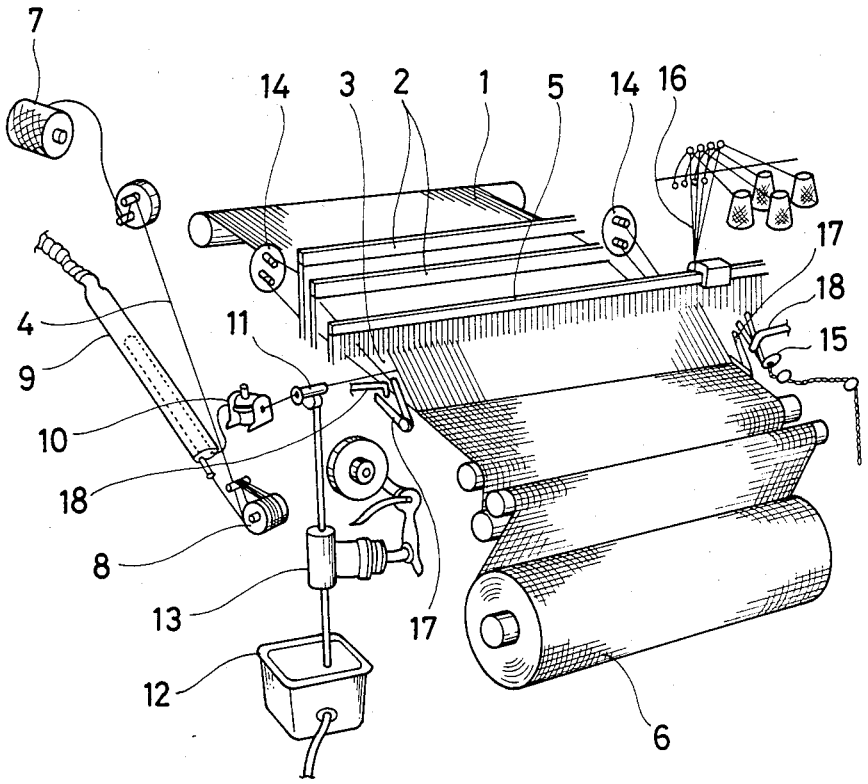
FIG. 1 is a perspective view of a water jet loom equipped with a yarn cutter according to the present invention.

Referring to FIG. 1, a shed 3 is formed through the alternate up-and-down motion of a pair of heddle frames 2 guiding a plurality of warp yarns 1 arranged in the shape of a band. A weft yarn 4 is inserted through the shed 3 across the arrangement of the warp yarns 1 and is then beaten up with a reed 5 so that a fabric 6 of a predetermined weft density is formed. The weft yarn 4 is taken out from a cheese 7 at a predetermined unwinding speed by means of a feed roller 8 at a predetermined speed and is pooled temporarily within a vacuum pool pipe 9. The weft yarn 4 thus pooled is then guided through a gripper 10 and jetted out from a jet nozzle 11 together with water. Pressurized water is supplied to the jet nozzle 11 from a water tank 12 by means of a pump 13. The weft yarn 4 is jetted out from the jet nozzle 11 into the shed 3 by the pressurized water.

One end of the weft yarn 4 beaten up with the reed 5 is gripped by the gripper 10, while the other end jetted across the loom to the other end thereof is arrested with weft yarn entangling threads 16 to tighten the weft yarn 4 at a fixed tension while the end of the weft yarn 4 is picked up with the weft yarn entangling threads 16 rotated by means of a yarn end entangling means, for instance, a false-twisting spindle 15. Both ends of the weft yarn 4 are cut by yarn cutters 17 of the present invention which are made of a ceramic material and are disposed at the opposite ends of the loom respectively. A water supply pipe 18 is disposed in the vicinity of each yarn cutter 17 to supply water to the yarn cutter 17. Dripping water from the water supply pipes 18 on the corresponding yarn cutters 17 removes textile wastes and dust produced due to the wear of the yarn cutters 17 and mitigates the wear of the cutting edges due to the mutual sliding movement between the cutting edges. The preferable water supply rate is 10 to 100 cc/min. In FIG. 1, selvage yarns are indicated at 14.

Figure 2:
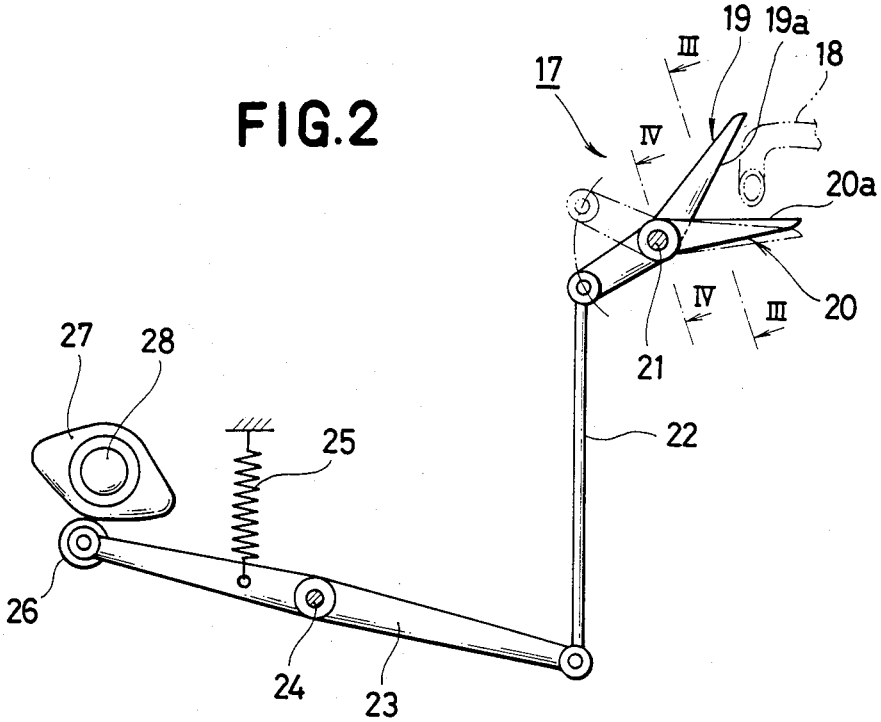
FIG. 2 is a side elevation of a yarn cutter according to the present invention and a driving mechanism for driving the same.
Figure 4:
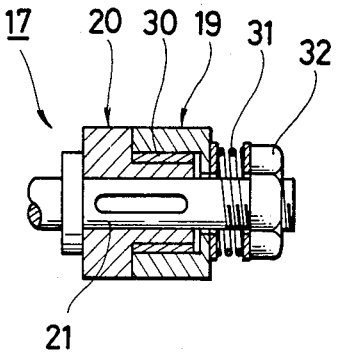
FIG. 4 is a sectional view taken along line IV—IV of FIG. 2.

Referring to FIG. 2, the yarn cutter comprises a pair of knife bodies 19 and 20 having cutting edges 19*a* and 20*a* on the mutually opposite sides thereof. The knife bodies 19 and 20 include the cutting edges 19*a* and 20*a*, respectively, and are formed of a ceramic material. As shown in FIG. 4, the knife body 20 is fixed to a shaft 21 and is held practically horizontally at a fixed position, whereas the knife body 19 is supported pivotally in a bearing 30 on the knife body 20 and is urged with a spring 31 so that the knife body 19 is pressed against the knife body 20. The pressure of the spring 31 can be adjusted by a nut 32. It is desirable to mount the knife bodies 19 and 20 on the shaft 21 to make the cutting edges 19*a* and 20*a* longitudinally intersect each other so that a large shearing force is produced between the cutting edges 19*a* and 20*a*.

Figure 3A:
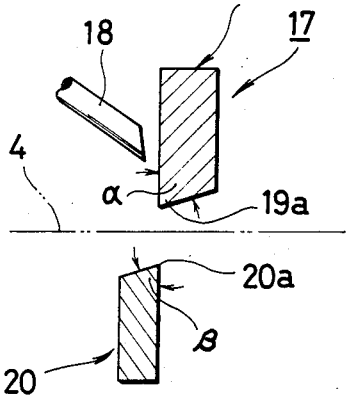
FIGS. 3A and 3B are sectional views of the yarn cutter of FIG. 2 taken along line III—III of FIG. 2.
Figure 3B:
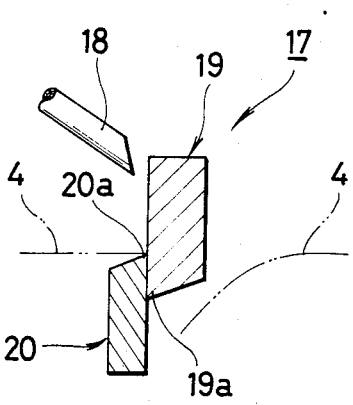

One end of a connecting rod 22 is connected pivotally to one end of the knife body 19, while the other end thereof is connected pivotally to one end of a lever 23. The lever 23 is supported pivotally at the central part thereof with a shaft 24 and is urged with a spring 25 so that a roller 26 provided at the other end thereof is always in contact with a cam 27. The cam 27 is fixed to the rocking shaft 28 of the loom and turns in synchronism with the rocking shaft 28. Accordingly, the rotation of the cam 27 causes the lever 23 to rock on the shaft 24 and thereby the knife body 19 is caused to reciprocate on the shaft 21 between a position shown by continuous lines and a position shown by broken lines through the up-and-down motion of the connecting rod 22. The reciprocating motion of the knife body 19 causes the relative sliding motion of the cutting edge 19*a* of the knife body 19 and the cutting edge 20*a* of the knife body 20 as shown in FIGS. 3A and 3B to shear the weft yarn 4 with the cutting edges 19*a* and 20*a*. The edge angles $\alpha$ and $\beta$ of the cutting edges 19*a* and 20*a* of the knife bodies 19 and 20, respectively, in the respective cross sections are acute angles which are smaller than 90°, preferably 20° to 80°, more preferably 20° to 60°. Such acute edge angles $\alpha$ and $\beta$ improve the weft yarn cutting effect of the yarn cutter. At least one of the edge angles $\alpha$ and $\beta$ is required to be an acute angle which is smaller than 90°, however, the other edge angle may be an angle of 90°.

The water supply pipe 18, which opens directing to the knife body 19, supplies water to the cutting edge 19*a* as well as to the cutting edge 20*a* of the knife body 20 disposed below the knife body 19. Consequently, the smooth relative sliding motion between the contiguous cutting edges 19*a* and 20*a* is attained and thereby the wear of the ceramic knife bodies is reduced further and the life of the yarn cutter is extended.

In order to attain satisfactory weft yarn cutting operation with those yarn cutters 17, the preferable contact pressure between the cutting edges 19*a* and 20*a* is 0.3 kg to 0.5 kg. When the contact pressure is maintained within such a pressure range during the operation of the yarn cutter, satisfactory yarn cutting operation can be attained and in addition, the life of the yarn cutter is extended still further.

Figure 5:
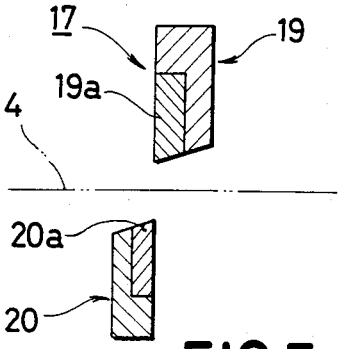
FIG. 5 is a longitudinal sectional view of the essential part of another embodiment of a yarn cutter according to the present invention.

An essential condition for the yarn cutter 17 of the present invention is to form at least the cutting edges of a ceramic material. Therefore, the knife bodies 19 and 20 including the cutting edges 19*a* and 20*a* may be formed of a ceramic material as in the case of the embodiment as described hereinbefore or it is possible to form only the cutting edges 19*a* and 20*a* of a ceramic material and to form the rest part of the knife body of an ordinary metal as shown in FIG. 5.

Figure 6:
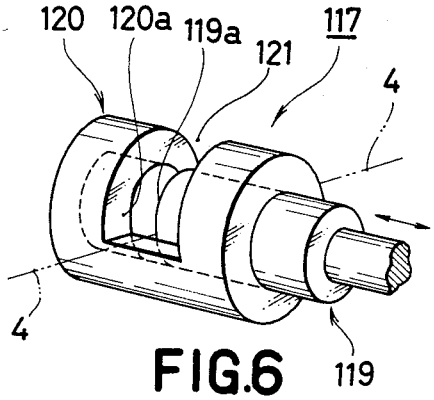
FIG. 6 is a perspective view of the essential part of still another embodiment of a yarn cutter according to the present invention.

FIG. 6 shows another embodiment of the present invention. Referring to FIG. 6, a yarn cutter 117 comprises a cylindrical ceramic body 120 and a cylindrical plunger 119 slidably fitted in the ceramic body 120. A recess 121 is formed in the middle part of the body 120. A cutting edge 120*a* is formed in the recess 121. A cutting edge 119*a* is formed at one end of the plunger 119. In this yarn cutter 117, a weft yarn 4 is inserted in tensioning condition through the recess 121 and is sheared with the cutting edges 119*a* and 120*a*.

Either a ceramic of the oxide group or a ceramic of the non-oxide group is applicable to the yarn cutter of the present invention. Preferable oxide ceramics are alumina ceramic, magnesia ceramic, zirconia ceramic and beryllia ceramic. The most preferable ceramics are zirconia ceramic and alumina ceramic. Preferable non-oxide ceramics are silica ceramic, silicon nitride ceramic and titanium carbide ceramic. A corrosion resistant, wear resistant and tough yarn cutter which is free from rusting under a wet environment can be provided when at least the cutting edges of the yarn cutter are formed of either of those ceramic materials. A particularly preferable ceramic for the cutting edges is the dispersion of zirconia containing cubic phase and zirconia containing tetragonal phase. Such a dispersion containing a content of 5 to 70 mol % of zirconic containing tetragonal phase has excellent corrosion resistance, wear resistance and toughness and is particularly superior in mechanical strength against thermal shock and bending. The zirconia ceramic may contain 70 mol % or less of monoclinic phase in addition to the cubic phase. Addition of the monoclinic phase improves further the mechanical strength of the material against thermal shock.

A composite sintered material of a ceramic and a metal, namely, a so called cermet, is applicable to the cutting edges of the yarn cutter of the present invention. A cermet is produced by sintering a ceramic powder and a metal powder. Cermets have the toughness and the plasticity of metals in addition to corrosion resistance and wear resistance. Preferable cermets are alumina-chromium cermets, alumina-silicon carbide cermets and carbide cermets containing 15 to 85 vol % of ceramic phase and the rest part of metal phase. Carbide cermets, in particular, are superior in wear resistance. Representative carbide cermets are tungsten-cobalt cermets, titanium carbide-cobalt cermets and multicomponent carbide-cobalt cermets.

The yarn cutter of the present invention as described hereinbefore exhibits high cutting performance owing to the use of ceramic materials for the cutting edges and has extended life owing to the high corrosion resistance, high wear resistance and increased toughness and hence, it improves the weaving efficiency of a shuttleless loom employing the yarn cutters of the present invention. Furthermore, since the yarn cutter of the present invention cuts weft yarns only through the relative sliding motion of a pair of knife bodies, only an extremely small amount of energy is required for driving the yarn cutter and the power consumption of the yarn cutter is reduced practically to zero as compared with the conventional yarn cutter employing electric heaters.

Although the embodiments of the present invention have been described as applied to a water jet loom, the present invention is applicable also to other shuttleless looms such as a rapier loom and an air jet loom. The use of the rotary motion of the rocking shaft is the most suitable means to drive the yarn cutter, however, the beating motion of the slay sword may be used for driving the yarn cutter.

The effects of the present invention will be described hereunder on the basis of the results of experiments.

Experiment 1

Figure 7:
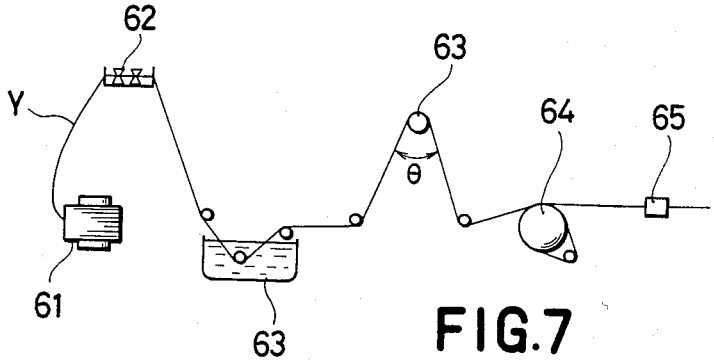
FIG. 7 is a schematic representation of a device for evaluating the wear resistance of materials.

FIG. 7 shows a wear testing device for testing the wear of materials resulting from the frictional action of a wet yarn.

A yarn Y taken out from a cheese 61 is guided into a water tank 63 through a tenser 62 to be made to wet, then is made to pass around a test piece 63 through a contact angle of $\theta$ and then is taken up by means of a take-up roller 64 and an aspirator 65. The yarn Y used for the test is a polyester yarn of 18 filaments and 50 deniers (a semi-dull polyester yarn containing titanium oxide). The test conditions are: yarn speed=250 m/min, yarn tension=30 g, contact angle=120° and test period=continuous 30 min.

Materials subjected to the test were: A=a martensite stainless steel (SAS-440C), B=a tungsten carbide sintered hard alloy, C=a high speed steel (SKH9), D=a zirconia ceramic and E=a carbide cermet. The materials D and E are used for the yarn cutter of the present invention.

The test results are shown in Table 1. Different yet obvious wear was found with the materials A, B and C, whereas no wear was found with the materials D and E.

TABLE 1

| Materials | A | B | C | D | E |
|---|---|---|---|---|---|
| Wear | Medium | Slight | Large | None | None |

Experiment 2

The respective power consumptions of a water jet loom equipped with a conventional electric heat yarn cutter and a water jet loom equipped with a shearing yarn cutter of the present invention were measured. The materials of yarn cutters of the present invention subjected to the first comparative test and the second comparative test were a zirconia ceramic and a carbide cermet, respectively. The weaving conditions for the first comparative test were: weaving width=150 cm, weaving speed=400 picks/min, weft yarn=polyester 65%/cotton 35% mixed spun yarn and weaving density=warp×weft: 105×75/in. The test results are shown in Table 2.

The weaving conditions for the second comparative test were: weaving width=150 cm, weaving speed=760 picks/min, weft yarn=150 deniers and 48 filaments false twisted polyester filament yarn and weaving density=warp×weft: 60×60/in. The results are shown in Table 3.

In the comparative test 1, the number of failures in cutting the weft yarn per 1,000,000 picks (approx. 400 m in woven length) was 9 times and 4 times for the conventional electric heat yarn cutter and for the yarn cutter of the present invention, respectively.

In the comparative test 2, the number of failures in cutting the weft yarn per 1,000,000 picks (approx. 423 m in woven length) was 7 times and 2 times for the conventional electric heat yarn cutter and for the yarn cutter of the present invention, respectively.

It is obvious from Tables 2 and 3 that the conventional electric heat yarn cutter consumes approximately 30% or greater of the total power consumption of the loom, whereas the yarn cutter of the present invention scarcely consumes power, so that the total power consumption of the loom is reduced.

TABLE 2

| | Heat cutter | | Yarn cutter of the invention | |
|---|---|---|---|---|
| | Power consumption (KWH) | Ratio (%) | Power consumption (KWH) | Ratio (%) |
| Main motor | 0.91 | 44.0 | 0.91 | 60.7 |
| Blower | 0.49 | 23.7 | 0.49 | 39.3 |
| Yarn cutter | 0.67 | 32.3 | — | — |
| Total | 2.07 | 100 | 1.50 | 100 |

TABLE 3

| | Heat cutter | | Yarn cutter of the invention | |
|---|---|---|---|---|
| | Power consumption (KWH) | Ratio (%) | Power consumption (KWH) | Ratio (%) |
| Main motor | 1.45 | 46.3 | 1.45 | 67.4 |
| Blower | 0.70 | 22.4 | 0.70 | 32.6 |
| Yarn cutter | 0.98 | 31.3 | — | — |
| Total | 3.13 | 100 | 2.15 | 100 |

Experiment 3

A yarn cutter having paired knife bodies each being made of a zirconia-yttria ceramic was mounted on a water jet loom and was subjected to a test. The test conditions were: weaving speed=400 picks/min, water supply to the yarn cutter=100 cc/min, warp yarn=polyester filament yarn, weft yarn=65 wt. % polyester/35 wt. % cotton, 45S mixed spun yarn, and weaving density=warp×weft: 105×75/in. No failure in cutting the weft yarn occurred during 1,000,000 picks (1000 m in woven length). When no water was supplied, the cutter failed in cutting the weft yarn twice per 1,000,000 picks.

In the weaving operation under the above conditions, the amount of wear of the cutter after the cutting operation of 3,000,000 times was 0.0033 mm, which is equivalent to a limiting cutting frequency of three billion 400 million times. When no water was supplied to the yarn cutter, the amount of wear of the cutter after the cutting operation of 3,000,000 times was 0.049 mm, which is equivalent to a limiting cutting frequency of approximately 50,000,000 times.

Thus the amount of wear of the cutter when water is supplied positively to the cutter is reduced approximately to 67% of the amount of wear of the cutter when no water is supplied to the cutter and the limiting cutting frequency of the cutter when water is supplied positively to the cutter was increased approximately by 68 times that of the cutter when no water is supplied to the cutter.

Experiment 4

Duration tests in a water jet loom were carried out of each of an electric heating yarn cutter (F), a scissors-type yarn cutter of a tungsten carbide (G) and a scissors-type yarn cutter of a zirconia ceramic according to the present invention (H), under the following conditions:

The water jet loom was operated at the rotation velocity of 400 rpm. The weft yarn subjected to cutting comprised a 75-denier, 36-filament polyester yarn.

For evaluation of the duration, it was regarded that the life of the yarn cutter was over when the cutter committed cutting failure ten times per 1,000,000 picks.

The duration values found were, in terms of the number of months (24 hours a day, 30 days a month), 2.5 for the cutter F, 4 for the cutter G and 8 for the cutter H.

We claim:

1. A yarn cutter for a shuttleless loom, comprising a pair of knife bodies each having a cutting edge and being driven for relative sliding motion in mutual contact, wherein the cutting edge of at least one of said knife bodies comprises at least one ceramic selected from the group consisting of ceramics of oxides, such as an alumina ceramic, a magnesia ceramic, a zirconia ceramic and beryllia ceramic, ceramics of non-oxides such as a silica ceramic, a silicon nitride ceramic and titanium carbide ceramic, and cermet and wherein said zirconia ceramic consists of a dispersion of cubic zirconia or tetragonal zirconia and the content of the tetragonal zirconia is 5 to 70%.

2. A yarn cutter according to claim 1, wherein one of said knife bodies is fixed, while the other is movable.

3. A yarn cutter according to claim 1, wherein a water supply means is disposed in the vicinity of said cutting edges.

4. A yarn cutter according to claim 1, wherein said ceramic is a cermet produced by sintering a mixture of a ceramic powder and a metal powder.

5. A yarn cutter according to claim 1, wherein said shuttleless loom is a water jet loom.

6. A yarn cutter according to claim 1, wherein the edge angle of said cutting edges as viewed in the cross section is an angle of below 90°.

7. A yarn cutter according to claim 1, wherein the edge angle of said cutting edges as viewed in the cross section is an angle of 20° to 80°.

8. A yarn cutter according to claim 1, wherein said yarn cutter is driven by the rocking shaft of said shuttleless loom.

* * * * *